US011817656B2

(12) United States Patent
Xu et al.

(10) Patent No.: US 11,817,656 B2
(45) Date of Patent: Nov. 14, 2023

(54) ELECTRICAL CONNECTOR HAVING OVERLAPPING COUPLING PORTIONS

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Yong-Chun Xu, Kunshan (CN); Hung-Chi Yu, New Taipei (TW); Chih-Ching Hsu, New Taipei (TW); Wei-Kang Liu, New Taipei (TW); Chin-Jung Wu, New Taipei (TW); Xiao-Qin Zheng, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 115 days.

(21) Appl. No.: 17/574,723

(22) Filed: Jan. 13, 2022

(65) Prior Publication Data

US 2022/0231461 A1 Jul. 21, 2022

(30) Foreign Application Priority Data

Jan. 18, 2021 (CN) ..... 202110060415.8

(51) Int. Cl.
*H01R 13/6471* (2011.01)
*H01R 24/62* (2011.01)
*H01R 107/00* (2006.01)

(52) U.S. Cl.
CPC ..... *H01R 13/6471* (2013.01); *H01R 24/62* (2013.01); *H01R 2107/00* (2013.01)

(58) Field of Classification Search
CPC ..... H01R 13/6471; H01R 2107/00; H01R 24/62; H01R 24/64

(Continued)

(56) References Cited

U.S. PATENT DOCUMENTS 5,716,237 A * 2/1998 Conorich ..... H01R 13/6464 439/701
5,791,943 A * 8/1998 Lo ..... H01R 13/6464 439/555

(Continued)

*Primary Examiner* — Marcus E Harcum
(74) *Attorney, Agent, or Firm* — Ming Chieh Chang

(57) ABSTRACT

An electrical connector includes an insulating body and first through eighth terminals sequentially arranged in a lateral direction in the insulating body, wherein the first and second terminals, the third and sixth terminals, the fourth and fifth terminals, and the seventh and eighth terminals are respectively used to transmit a pair of differential signals, each terminal including: a mating portion for mating to a mating connector; a tail portion opposite to the mating portion; and a connecting portion connected therebetween, the connecting portions of the third terminal to the fifth terminal are all provided with a coupling portion; wherein the coupling portions of the third through fifth terminals are in three different planes, respectively, and the coupling portion of the fifth terminal and the coupling portion of the third terminal at least partially overlap in a longitudinal direction perpendicular to the lateral direction.

12 Claims, 11 Drawing Sheets

(58) Field of Classification Search
USPC ..... 439/676, 941, 620.17, 620.19, 607.38
See application file for complete search history.

(56) References Cited

U.S. PATENT DOCUMENTS 5,941,734 A * 8/1999 Ikeda ..... H01R 24/64 439/676
6,099,357 A * 8/2000 Reichle ..... H01R 13/6467 439/676
6,120,329 A 9/2000 Steinman
6,261,132 B1 * 7/2001 Koseki ..... H01R 13/41 439/733.1
6,305,952 B1 * 10/2001 Yu ..... H01R 12/716 439/83
6,443,776 B2 * 9/2002 Reichle ..... H01R 13/2421 439/676
6,447,341 B1 * 9/2002 Hyland ..... H01R 24/64 439/676
7,048,550 B2 * 5/2006 Hyland ..... H01R 31/005 439/67
7,052,328 B2 5/2006 Ciezak et al.
7,134,917 B2 * 11/2006 Deng ..... H01R 12/716 439/676
7,628,656 B2 12/2009 Shields et al.
7,641,521 B2 1/2010 Pepe et al.
7,713,094 B1 * 5/2010 Sparrowhawk .... H01R 13/6463 439/676
8,313,338 B2 * 11/2012 Hogue ..... H01R 9/031 439/676
8,979,578 B2 * 3/2015 Hogue ..... H01R 9/031 439/540.1
9,520,687 B2 * 12/2016 Gao ..... H01R 13/7193
9,531,143 B2 * 12/2016 Gao ..... H01R 24/64
10,734,765 B2 * 8/2020 Hammond, Jr. ..... H05K 1/0213
2005/0227524 A1 * 10/2005 Zhuang ..... H01R 13/7035 439/188
2010/0136846 A1 * 6/2010 Pharney ..... H01R 24/64 439/676
2010/0190366 A1 * 7/2010 Fitzpatrick ..... H01R 27/00 439/147
2010/0221956 A1 * 9/2010 Pepe ..... H01R 24/64 439/676
2016/0020567 A1 * 1/2016 Belopolsky ..... H01R 24/64 439/620.22

* cited by examiner

ELECTRICAL CONNECTOR HAVING OVERLAPPING COUPLING PORTIONS

BACKGROUND OF THE INVENTION

1. Field of the Invention

The present invention relates generally to an electrical connector, and more particularly to an electrical connector capable of reducing crosstalk interference between conductive terminals.

2. Description of Related Arts

With the increase of data transmission speed, how to reduce or eliminate the crosstalk interference in the electrical connector becomes very important. A conventional electrical connector has a total of 8 terminals forming four channels—a third terminal and a sixth terminal forming a second channel to transmit a pair of differential signals and a fourth terminal and a fifth terminal forming a third channel to transmit a pair of differential signals. The fourth terminal and the fifth terminal are sandwiched between the third terminal and the sixth terminal, causing the four terminals in the second channel and the third channel to have the largest cross talk interference among the eight terminals. Reducing crosstalk between terminals has become an urgent problem in the industry.

U.S. Pat. No. 6,120,329 discloses an electrical connector comprising a first to eighth conductive terminals arranged horizontally, wherein the third terminal and the fifth terminal are laterally close, and the fourth terminal and the sixth terminal are laterally close. Assume that the crosstalk between the third terminal and the fourth terminal is a, the crosstalk between the third terminal and the fifth terminal is b. Because the distance between the third terminal and the fourth terminal is closer, the value of a is much greater than the value of b. In order to increase balance, the third terminal is close to the fifth terminal to increase the value of b, so that the value of (a-b) is reduced. However, the third terminal and the fifth terminal are laterally close, and the fourth terminal and the sixth terminal are laterally close to balance their crosstalk interference caused by the distance, However, the close parts of the third terminal and the fifth terminal are located in the same plane, and the close parts of the fourth terminal and the sixth terminal are located in the same plane, make the distance that the terminal can approach in the lateral direction is limited, and the adjustment ability is limited.

An improved electrical connector is desired.

SUMMARY OF THE INVENTION

A main object of the present invention is to provide an electrical connector which can effectively reduce crosstalk interference between electrical terminals.

To achieve the above-mentioned object, an electrical connector comprises an insulating body and first through eighth terminals sequentially arranged in a lateral direction in the insulating body, wherein the first and second terminals, the third and sixth terminals, the fourth and fifth terminals, and the seventh and eighth terminals are respectively used to transmit a pair of differential signals, each terminal including: a mating portion for mating to a mating connector; a tail portion opposite to the mating portion; and a connecting portion connected between the tail portion and the mating portion, the connecting portions of the third terminal to the fifth terminal are all provided with a coupling portion; wherein the coupling portions of the third through fifth terminals are in three different planes, respectively, and the coupling portion of the fifth terminal and the coupling portion of the third terminal at least partially overlap in a longitudinal direction perpendicular to the lateral direction Compared to prior art, in the electrical connector of the present invention, the coupling portions of the third terminal to the fifth terminal are in three different planes, respectively, and the coupling portion of the fifth terminal and the coupling portion of the third terminal can be overlapped in the longitudinal direction perpendicular to the lateral direction. The capacitive coupling benefit of the third terminal and the fifth terminal is increased to effectively reduce the crosstalk interference between the terminals.

DETAILED DESCRIPTION OF THE PREFERRED EMBODIMENT

Figure 1:
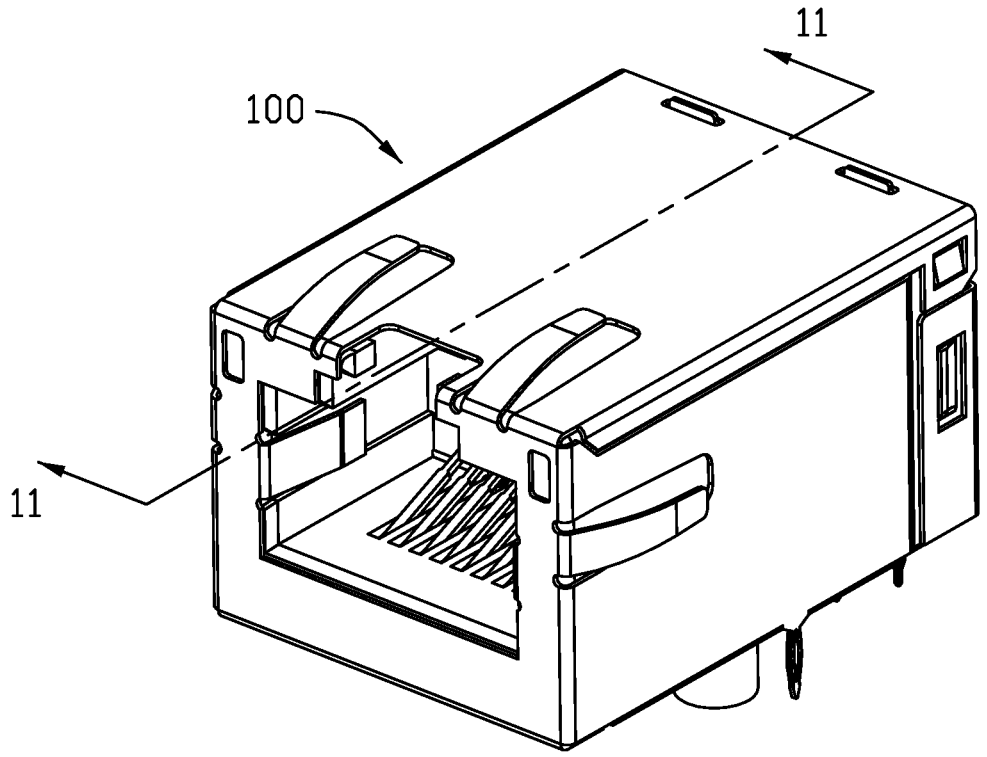
FIG. 1 is a perspective view of an electrical connector in accordance with the present invention.
Figure 2:
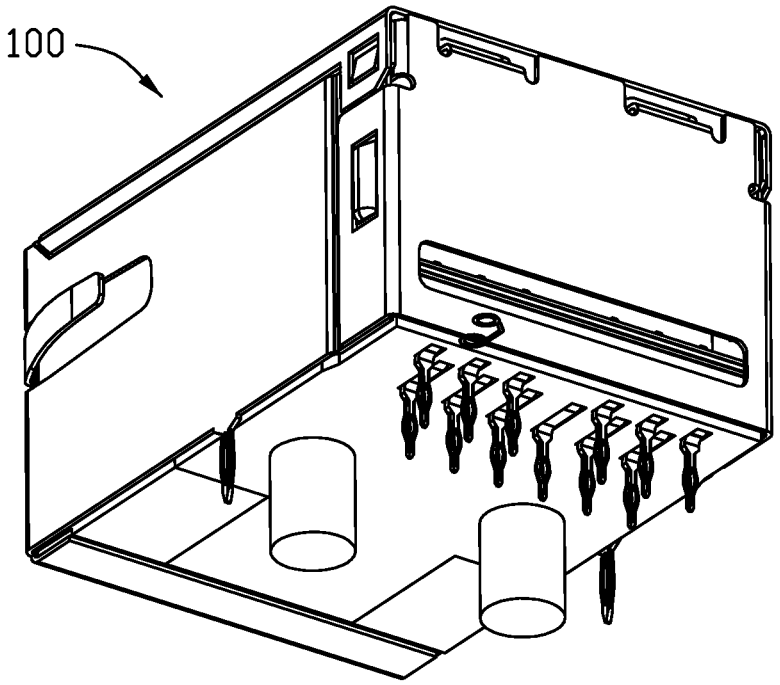
FIG. 2 is another perspective view of the electrical connector in FIG. 1.
Figure 3:
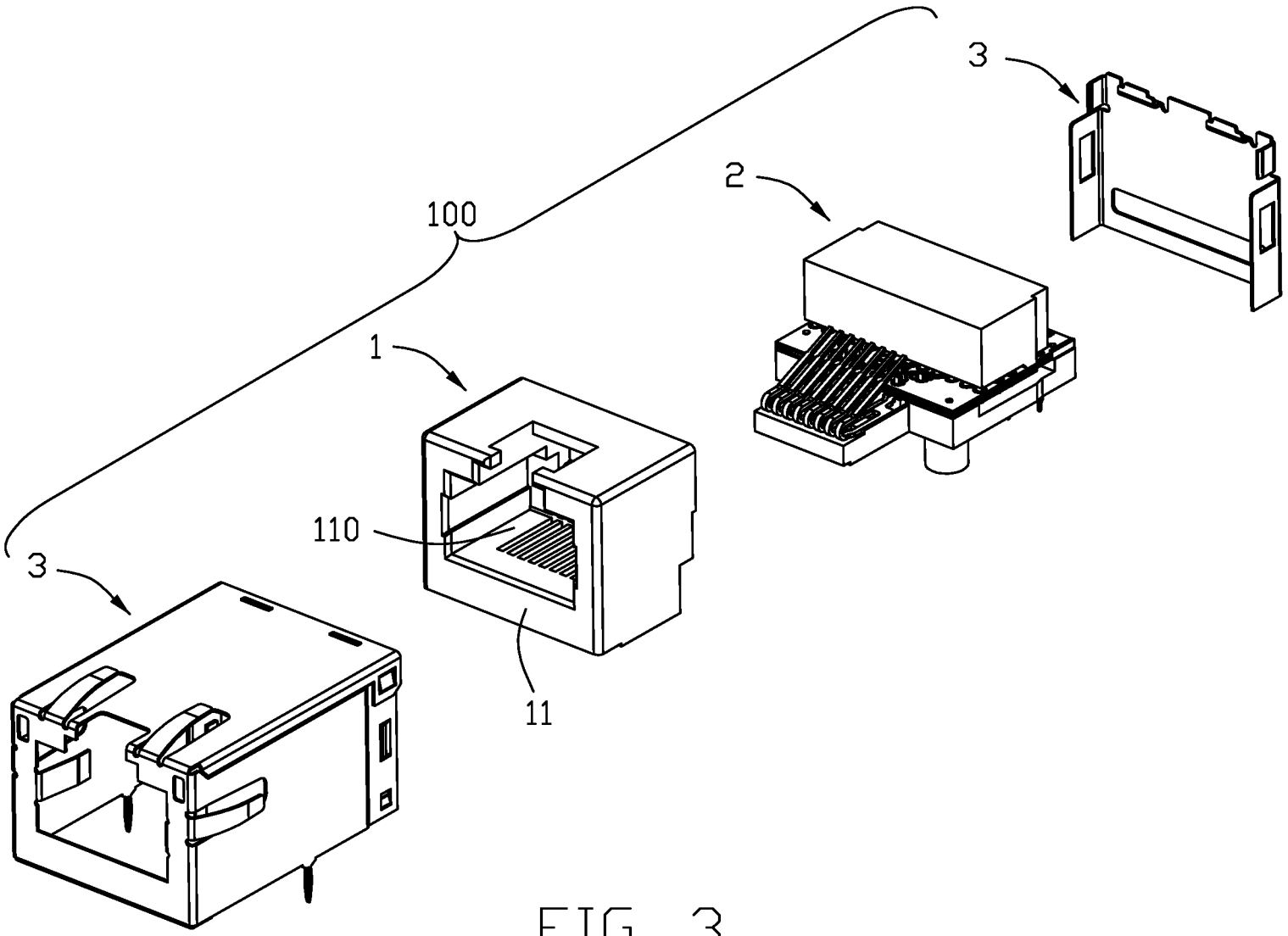
FIG. 3 is an exploded view of the electrical connector in FIG. 1.
Figure 4:
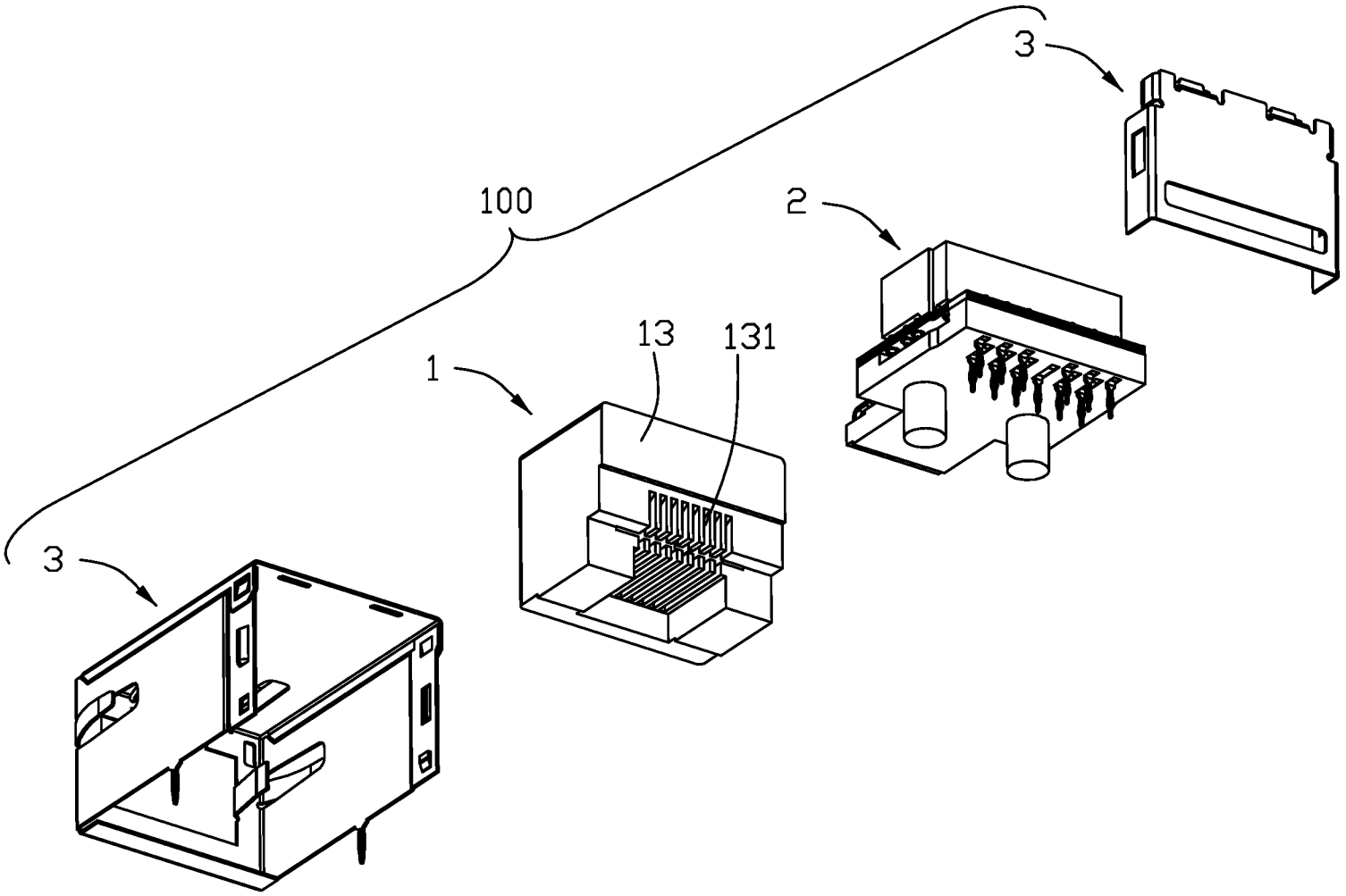
FIG. 4 is another exploded view of the electrical connector in FIG. 3.
Figure 5:
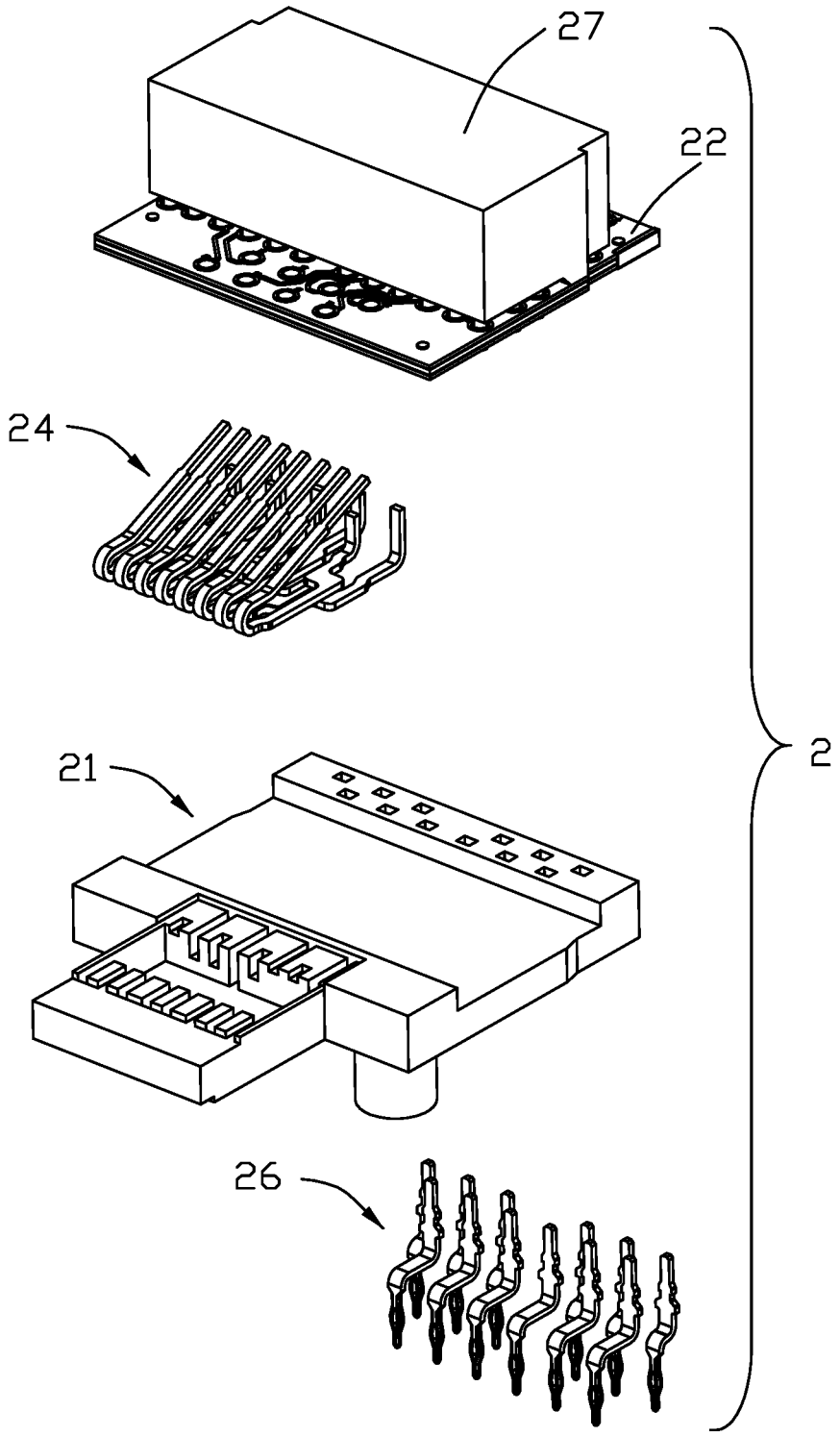
FIG. 5 is an exploded view of the terminal module of the electrical connector in FIG. 3.
Figure 6:
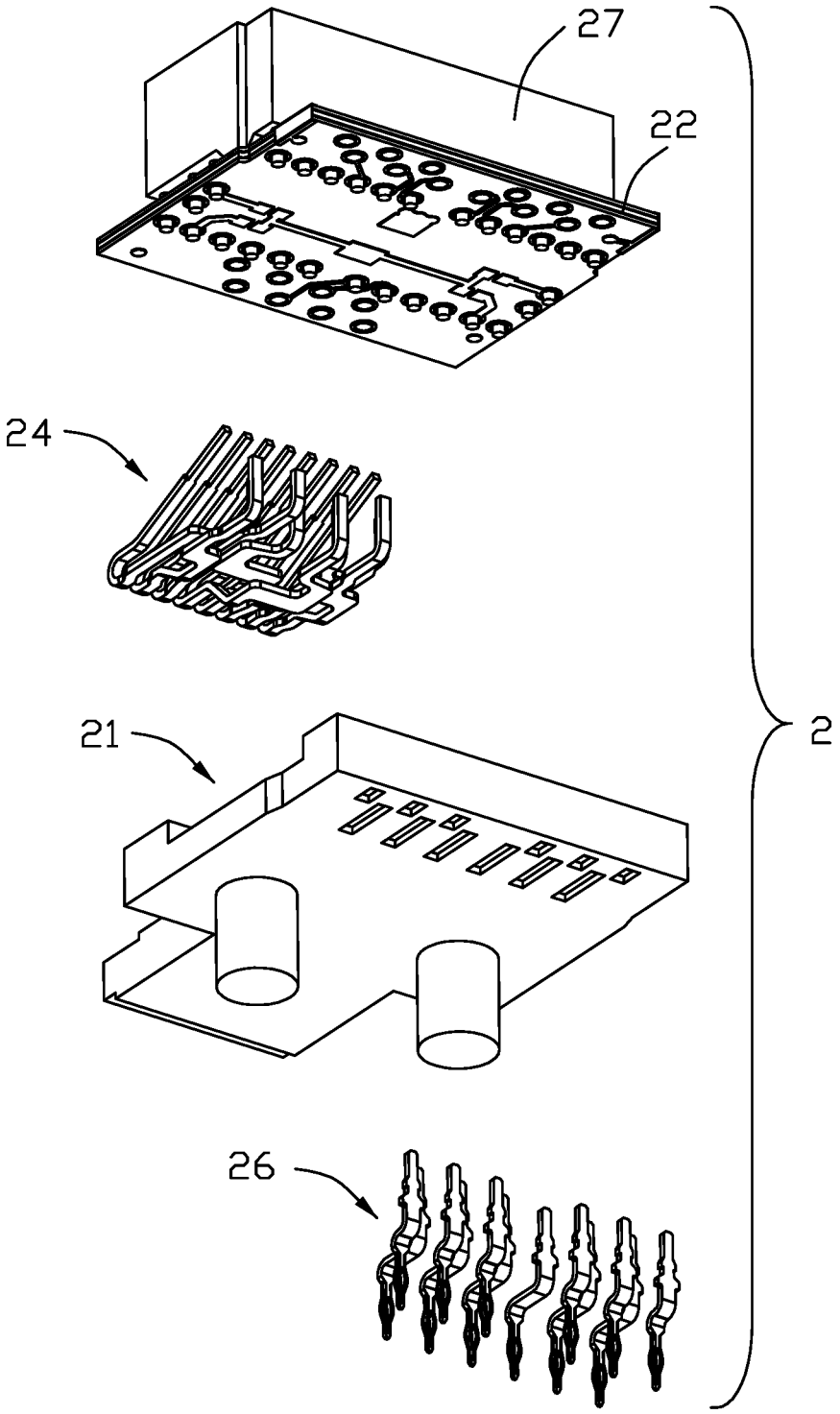
FIG. 6 is another exploded view of the terminal module of the electrical connector in FIG. 5.
Figure 7:
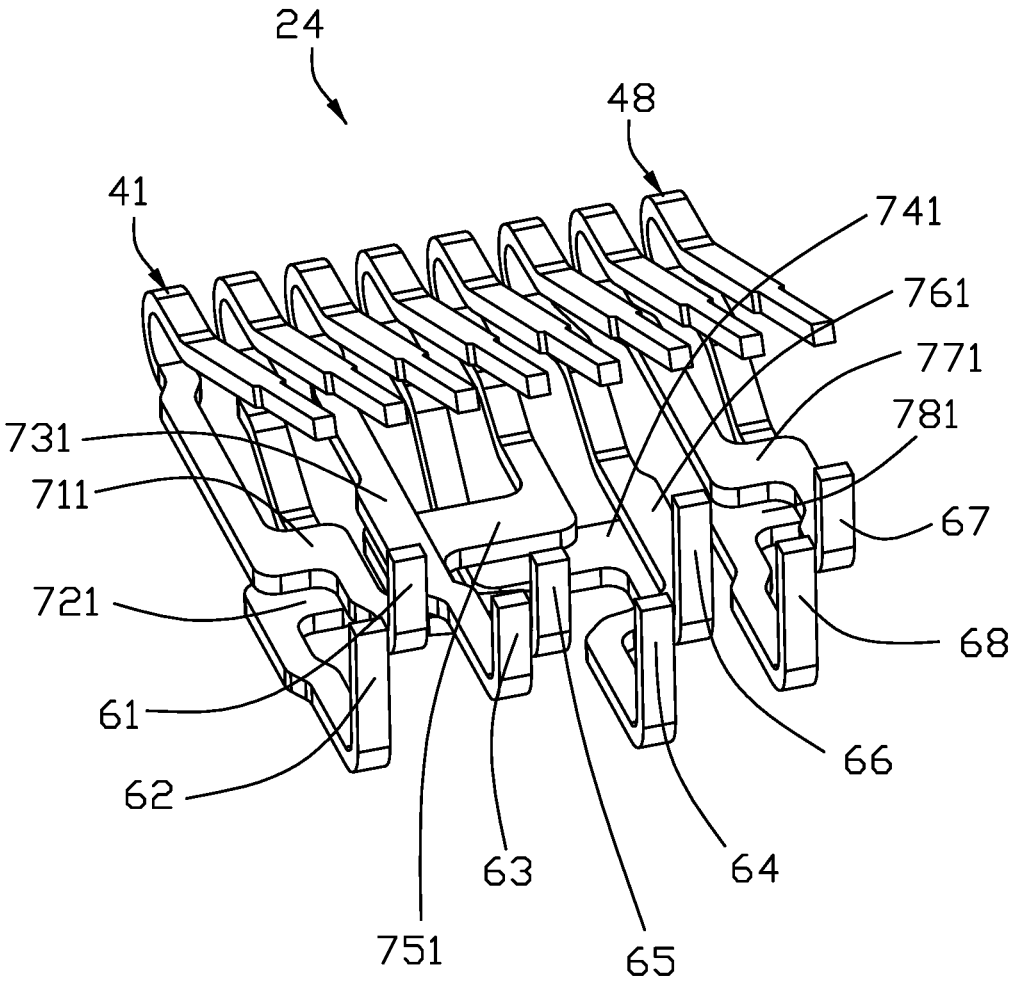
FIG. 7 is a perspective view of the mating terminal of the terminal module in FIG. 5.
Figure 8:
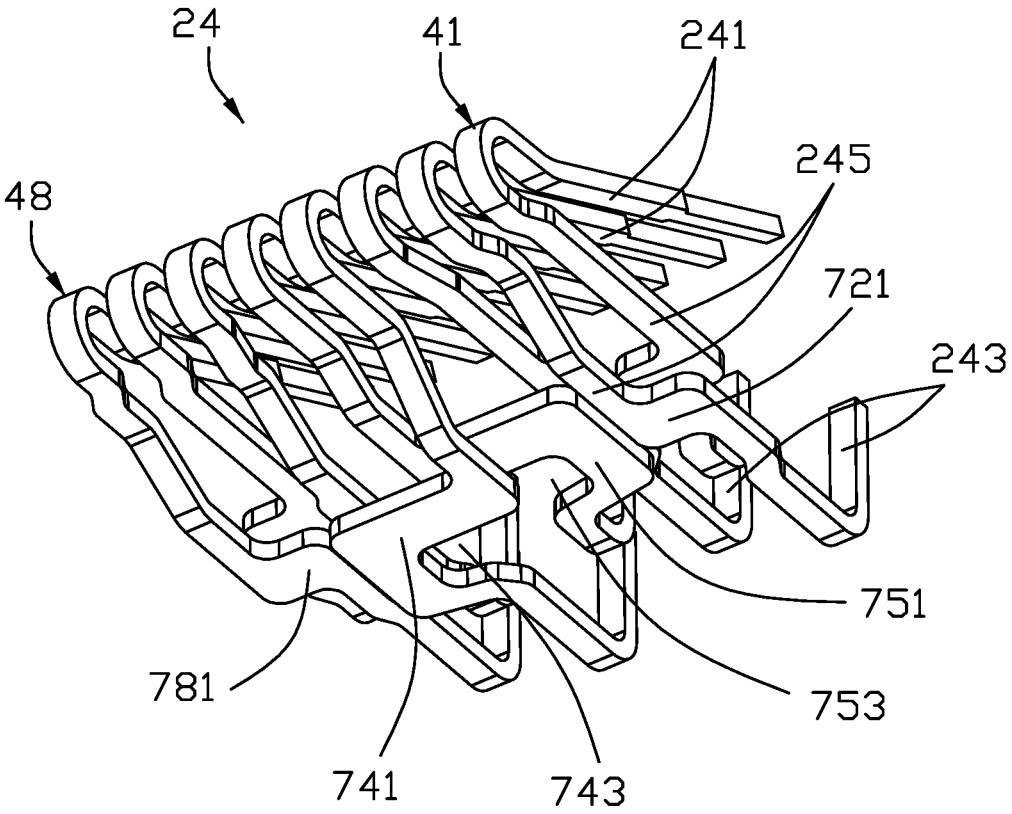
FIG. 8 is a another perspective view of the mating terminal of the terminal module in FIG. 7.
Figure 9:
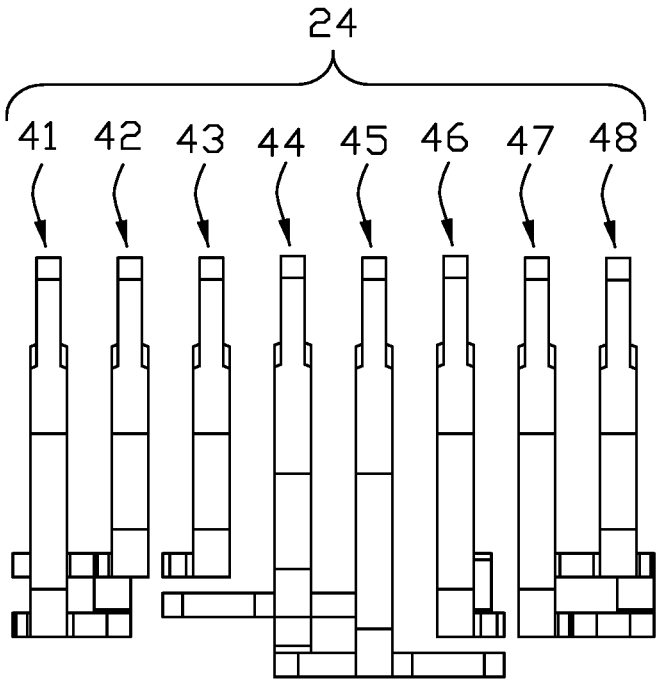
FIG. 9 is a rear view of mating terminal of the terminal module in FIG. 7.
Figure 10:
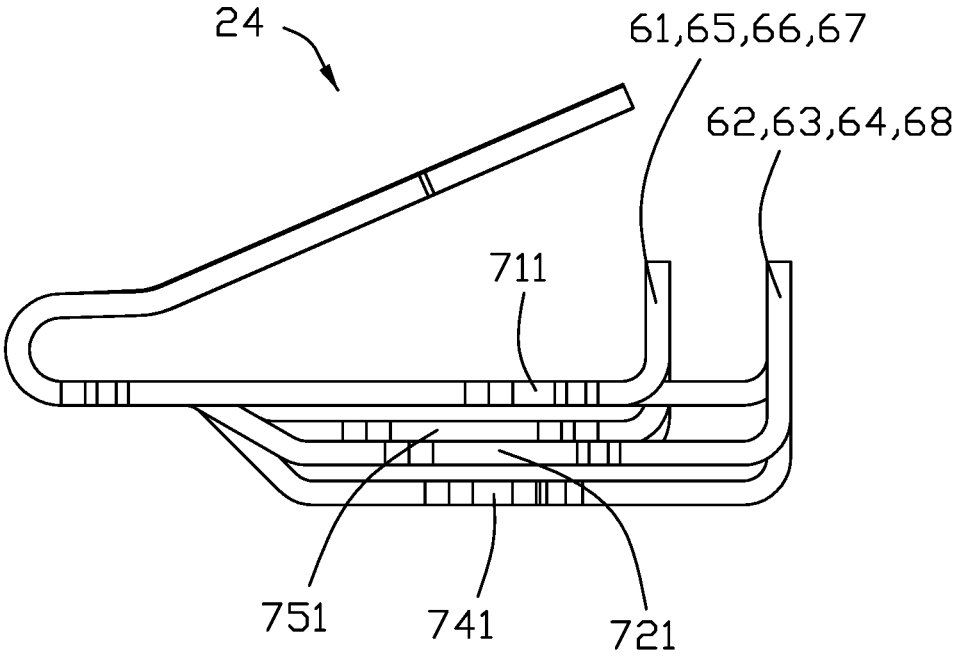
FIG. 10 is a front view of mating terminal of the terminal module in FIG. 7.
Figure 11:
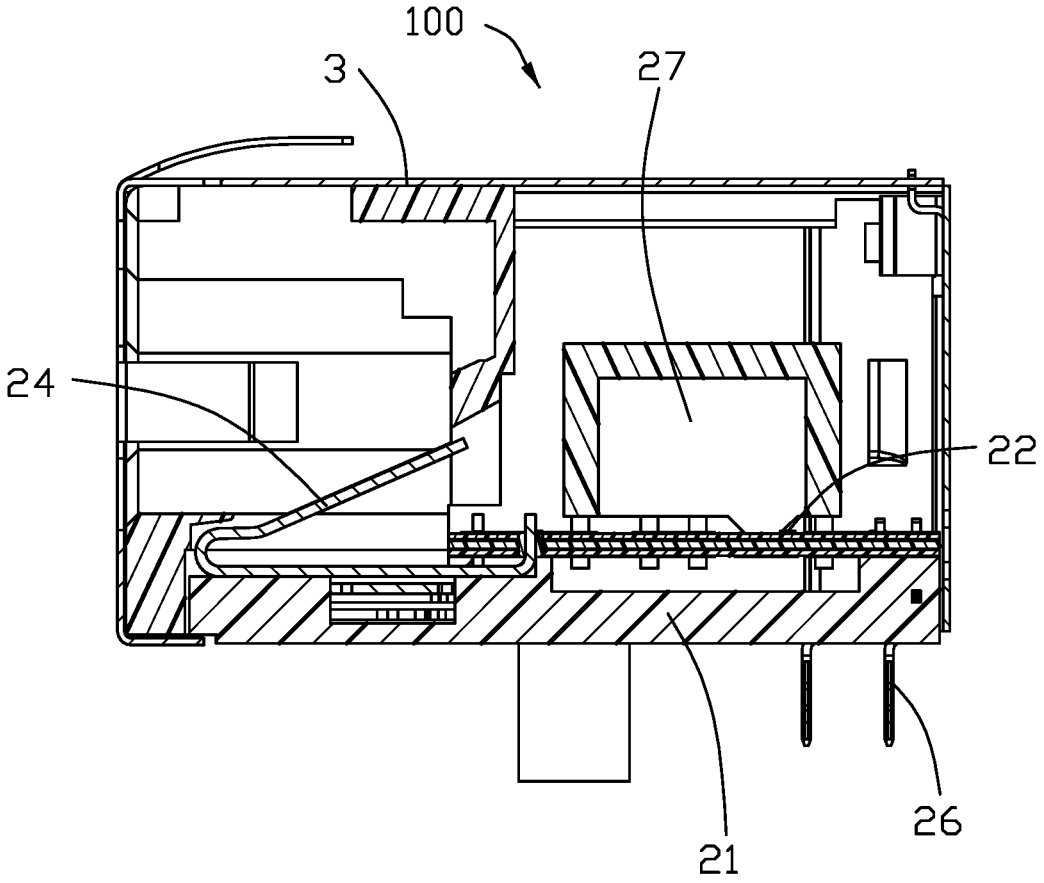
FIG. 11 is a cross-sectional view taken along line 11-11 of the electrical connector in FIG. 1.

Referring to FIGS. 1-11, an electrical connector 100 of the present invention is shown. The electrical connector 100 can be mated with a mating connector (not shown). The electrical connector 100 comprises an insulating body 1 and a terminal modules 2 installed at the rear of the insulating body 1, a metal shielding shell 3 covering the outer side of the insulating body 1 and the terminal module 2.

The insulating body 1 includes a front wall 11 and a rear wall 13 opposite to the front wall 11. The front wall 11 is provided with a receiving cavity 110 recessed inward to receive the mating connector. The rear wall 13 is provided with a row of partition groove 131 arranged in a transverse direction. The partition groove 131 communicates with the receiving cavity 110 in the front-to-back direction.

The terminal module 2 includes an insulating carrier 21, a circuit board 22 on the insulating carrier 21, a mating terminal 24 mounted on the circuit board 22, a row of foot terminals 26 that are mounted on the circuit board 22 and can be mounted to an external circuit board (not shown) and a magnetic module 27 that is mounted on the circuit board 22 and electrically connected between the mating terminal 24 and the foot terminal 26. The mating terminal 24 is installed to the receiving cavity 110 through the partition groove 131.

The mating terminal 24 includes a first terminal 41 to an eighth terminal 48 arranged in order from left to right in the transverse direction and mounted on the front end of the circuit board 22, wherein the first terminal 41 and the second terminal 42 form a first differential terminal pair, the third terminal 43 and the sixth terminal 46 form a second differential terminal pair, the fourth terminal 44 and the fifth terminal 45 form a third differential terminal pair, and the seventh terminal 47 and the eighth terminal 48 form a fourth differential terminal pair, in this way, the third differential terminal pair is located between the second differential terminal pair in the lateral direction.

Each of the mating terminals 24 includes an obliquely arranged mating portion 241 for mating with the mating connector, a tail portion 243 that can be mounted on the circuit board and a connecting portion 245 between the tail portion 243 and the mating portion 241. Each of the connecting portions 245 includes a coupling portion. The respective tails portions of the first terminal 41 to the eighth terminal 48 are defined as a first tail portions 61 to an eighth tail portions 68. The coupling portions corresponding to each of the first terminal 41 to the eighth terminal 48 are defined as a first coupling portion 711 to an eighth coupling portion 781. The size of the first coupling portion 711 to the eighth coupling portion 781 in the lateral direction is larger than the lateral size of the other parts of the corresponding terminals. The third coupling portion 731 of the third terminal 43 to the fifth coupling portion 751 of the fifth terminal 45 are respectively in three different planes. The fifth coupling portion 751 of the fifth terminal 45 is close to the third coupling portion 731 of the third terminal 43 in the lateral direction. Specifically, the fifth coupling portion 751 of the fifth terminal 45 and the third coupling portion 731 of the third terminal 43 at least partially overlap in the longitudinal direction perpendicular to the lateral direction. The fourth coupling portion 741 of the fourth terminal 44 to the sixth coupling portion 761 of the sixth terminal 46 are located in three different planes. The fourth coupling portion 741 of the fourth terminal 44 is close to the sixth coupling portion 761 of the sixth terminal 46 in the lateral direction. Specifically, the sixth coupling portion 761 of the sixth terminal 46 and the fourth coupling portion 741 of the fourth terminal 44 may at least partially overlap in the longitudinal direction. In this embodiment, The third coupling portion 731 of the third terminal 43 to the sixth coupling portion 761 of the sixth terminal 46 are in four planes parallel to each other in the longitudinal direction perpendicular to the mating direction and perpendicular to the transverse direction. The third coupling portion 731 of the third terminal 43, the fifth coupling portion 751 of the fifth terminal 45, the sixth coupling portion 761 of the sixth terminal 46, and the fourth coupling portion 741 of the fourth terminal 44 are arranged in order from top to bottom in the longitudinal direction. The distance between the third coupling portion 731 of the third terminal 43 and the fifth coupling portion 751 of the fifth terminal 45 is equal to the distance between the sixth coupling portion 761 of the sixth terminal 46 and the fourth coupling portion 741 of the fourth terminal 44 in the longitudinal direction. The distance between the coupling portions of the third terminal 43 and the sixth terminal 46 in the longitudinal direction is equal to the distance between the coupling portions of the fifth terminal 45 and the fourth terminal 44 in the longitudinal direction. The lateral dimension of the fourth coupling portion 741 of the fourth terminal 44 and the fifth coupling portion 751 of the fifth terminal 45 is larger than the lateral dimension of the other coupling portions of the first coupling portion 711 to the eighth coupling portion 781. The left side of the fifth coupling portion 751 of the fifth terminal 45 does not exceed the left side of the third coupling portion 731 of the third terminal 43. The right side of the fourth coupling portion 741 of the fourth terminal 44 does not exceed the right side of the sixth coupling portion 761 of the sixth terminal 46. The fourth coupling portion 741 of the fourth terminal 44 is provided with a hollow portion 743. The fifth coupling portion 751 of the fifth terminal 45 is provided with a hollow portion 753. The hollow portions 743, 753 are used to adjust impedance matching between terminals. Specifically, in this embodiment, the hollow portion 753 of the fifth terminal 45 is recessed to the left from the right side of the fifth terminal 45, and the hollow portion 743 of the fourth terminal 44 is recessed from the left side to the right side of the fourth terminal.

The first coupling portion 711 of the first terminal 41 and the seventh coupling portion 771 of the seventh terminal 47 are located in the same plane as the third coupling portion 731 of the third terminal 43. The second coupling portion 721 of the second terminal 42 and the eighth coupling portion 781 of the eighth terminal 48 are in the same plane as the sixth coupling portion 761 of the sixth terminal 46. The coupling portions of each pair of differential terminals have the same distance in the longitudinal direction. The first coupling portion 711 of the first terminal 41 and the second coupling portion 721 of the second terminal 42 are close to each other in the lateral direction and at least partially overlap in the longitudinal direction. The seventh coupling portion 771 of the seventh terminal 47 and the eighth coupling portion 781 of the eighth terminal 48 are close to each other in the lateral direction and at least partially overlap in the longitudinal direction. Specifically, in this embodiment, the first coupling portion 711 of the first terminal 41 and the second coupling portion 721 of the second terminal 42 cross in the lateral direction. The seventh coupling portion 771 of the seventh terminal 47 and the eighth coupling portion 781 of the eighth terminal 48 cross in the lateral direction. The second tail portion 62 of the second terminal 42 is located outside the first tail portion 61 of the first terminal 41. The seventh tail portion 67 of the seventh terminal 47 is located outside the eighth tail portion 68 of the eighth terminal 48. The fourth coupling portion 741 of the fourth terminal 44 and the fifth coupling portion 751 of the fifth terminal 45 cross in the lateral direction. The fourth tail portion 64 of the fourth terminal 44 is located on the right side of the fifth tail portion 65 of the fifth terminal 45.

The first tail portion 61 of the first terminal 41, the fifth tail 65 of the fifth terminal 45, the sixth tail portion 66 of the sixth terminal 46, and the seventh tail portion 67 of the seventh terminal 47 are arranged in a first row in the transverse direction and are located in the same plane. The tail portions of the remaining terminals are arranged in a second row in the transverse direction, and are located in another plane that is different from the same plane.

In the present invention, the coupling portions of the third terminal 43 to the fifth terminal 45 are arranged in three different planes to increase the space between the third coupling portion 731 and the fifth coupling portion 751 in the lateral direction close to each other, therefore the fifth coupling portion 751 and the third coupling portion 731 can be overlapped in the longitudinal direction perpendicular to the lateral direction, which increases the capacitive coupling benefit between the third terminal 43 and the fifth terminal 45, thereby effectively reducing the crosstalk between the terminals.

What is claimed is:

1. An electrical connector comprising: an insulating body; and first through eighth terminals sequentially arranged in a lateral direction in the insulating body, wherein the first and second terminals, the third and sixth terminals, the fourth and fifth terminals, and the seventh and eighth terminals are respectively used to transmit a pair of differential signals, each terminal including: a mating portion for mating to a mating connector; a tail portion opposite to the mating portion; and a connecting portion connected between the tail portion and the mating portion, the connecting portions of the third terminal to the fifth terminal are all provided with a coupling portion; wherein the coupling portions of the third through fifth terminals are in three different planes, respectively, and the coupling portion of the fifth terminal and the coupling portion of the third terminal at least partially overlap in a longitudinal direction perpendicular to the lateral direction; wherein the sixth terminal is provided with a coupling portion, the coupling portion of the fourth terminal and the coupling portion of the sixth terminal at least partially overlap in the longitudinal direction; and the coupling portions of the third through sixth terminals are located in four planes parallel to each other in the longitudinal direction.

2. The electrical connector as claimed in claim 1, wherein the coupling portion of the third terminal, the coupling portion of the fifth terminal, the coupling portion of the sixth terminal, and the coupling portion of the fourth terminal are arranged in order from top to bottom.

3. The electrical connector as claimed in claim 2, wherein the dimension of the coupling portion of the fourth terminal in the lateral direction is larger than the dimension of other portions of the fourth terminal in the lateral direction.

4. The electrical connector as claimed in claim 1, wherein each of the coupling portion of the fourth terminal and the coupling portion of the fifth terminal is provided with a hollow portion to match the impedance between the terminals.

5. The electrical connector as claimed in claim 1, wherein the coupling portion of the fifth terminal does not exceed the side of the coupling portion of the third terminal away from the fifth terminal in the lateral direction.

6. The electrical connector as claimed in claim 5, wherein the coupling portion of the fourth terminal does not exceed the side of the coupling portion of the sixth terminal away from the fourth terminal in the lateral direction.

7. The electrical connector as claimed in claim 1, wherein each of the first terminal and the second terminal comprises a coupling portion, and the coupling portion of the first terminal and the coupling portion of the second terminal are close to each other and at least partially overlap in the lateral direction.

8. The electrical connector as claimed in claim 7, wherein each of the seventh terminal and the eighth terminal comprises a coupling portion, and the coupling portion of the seventh terminal and the coupling portion of the eighth terminal are close to each other and at least partially overlap in the lateral direction.

9. The electrical connector as claimed in claim 8, wherein the coupling portion of the first terminal and the coupling portion of the seventh terminal are in same plane as the coupling portion of the third terminal, and the coupling portion of the second terminal and the coupling portion of the eighth terminal are in same plane as the coupling portion of the sixth terminal.

10. The electrical connector as claimed in claim 1, wherein the tail portions of the first terminal, the fifth terminal, the sixth terminal, and the seventh terminal are in same plane, and the tail portions of the remaining terminals are in another plane.

11. The electrical connector as claimed in claim 1, wherein the distance between the coupling portion of the third terminal and the coupling portion of the sixth terminal in the longitudinal direction is equal to the distance between the coupling portion of the fifth terminal and the coupling portion of the fourth terminal in the longitudinal direction.

12. The electrical connector as claimed in claim 11, wherein the distance between the coupling portion of the third terminal and the coupling portion of the fifth terminal in the longitudinal direction is equal to the distance between the coupling portion of the sixth terminal and the coupling portion of the fourth terminal in the longitudinal direction.

* * * * *